US012123592B2

(12) United States Patent
Bucaro et al.

(10) Patent No.: US 12,123,592 B2
(45) Date of Patent: Oct. 22, 2024

(54) FUEL NOZZLE AND SWIRLER

(71) Applicant: General Electric Company, Schenectady, NY (US)

(72) Inventors: Michael T. Bucaro, Arvada, CO (US); Clayton S. Cooper, Evendale, OH (US)

(73) Assignee: General Electric Company, Evendale, OH (US)

( * ) Notice: Subject to any disclaimer, the term of this patent is extended or adjusted under 35 U.S.C. 154(b) by 41 days.

(21) Appl. No.: 17/686,904

(22) Filed: Mar. 4, 2022

(65) Prior Publication Data

US 2023/0220993 A1 Jul. 13, 2023

Related U.S. Application Data

(60) Provisional application No. 63/298,784, filed on Jan. 12, 2022.

(51) Int. Cl.

| | |
|---|---|
| ***F23D 14/62*** | (2006.01) |
| ***F23D 14/58*** | (2006.01) |
| ***F23D 14/70*** | (2006.01) |
| ***F23R 3/06*** | (2006.01) |
| ***F23R 3/28*** | (2006.01) |

(52) U.S. Cl.
CPC ..... *F23D 14/62* (2013.01); *F23D 14/58* (2013.01); *F23D 14/70* (2013.01); *F23R 3/06* (2013.01); *F23R 3/286* (2013.01)

(58) Field of Classification Search
CPC .... F23R 3/14; F23R 3/06; F23R 3/286; F23D 14/58; F23D 14/60; F23D 14/62; F23D 14/70
See application file for complete search history.

(56) References Cited

U.S. PATENT DOCUMENTS

| | | | | |
|---|---|---|---|---|
| 3,930,368 A * | 1/1976 | Anderson | ..... | F23R 3/26 60/39.23 |
| 3,958,413 A * | 5/1976 | Cornelius | ..... | F23R 3/14 60/39.23 |
| 4,151,711 A * | 5/1979 | Fromm | ..... | F23R 3/26 60/39.23 |

(Continued)

FOREIGN PATENT DOCUMENTS

| | | |
|---|---|---|
| EP | 1873455 A1 | 1/2008 |
| EP | 3312510 A1 | 10/2017 |

(Continued)

*Primary Examiner* — Gerald L Sung
*Assistant Examiner* — Jacek Lisowski
(74) *Attorney, Agent, or Firm* — McGarry Bair PC

(57) ABSTRACT

A turbine engine can include a compressor section, a combustion section, and a turbine section in serial flow arrangement. The combustion section can include a combustor liner, a dome assembly coupled to the combustor liner, a fuel nozzle fluidly coupled to the dome assembly, a combustion chamber fluidly coupled to the fuel nozzle, and at least one set of dilution openings located in the dome assembly or combustor liner that fluidly couple to the combustion chamber. A swirler can define at least one passage extending between at least one annular entrance and at least one annular exit, wherein the at least one annular entrance is fluidly coupled to the compressor section. A variable area device is movable relative to the at least one set of dilution openings or at least a portion of the swirler.

20 Claims, 12 Drawing Sheets

(56) References Cited

U.S. PATENT DOCUMENTS

| | | | | | |
|---|---|---|---|---|---|
| 4,606,190 | A * | 8/1986 | Greene | F23C 7/004 | 60/39.23 |
| 5,357,743 | A * | 10/1994 | Zarzalis | F23C 7/006 | 60/39.23 |
| 5,373,693 | A * | 12/1994 | Zarzalis | F23R 3/14 | 60/39.23 |
| 5,394,688 | A * | 3/1995 | Amos | F23R 3/26 | 60/39.23 |
| 5,490,378 | A * | 2/1996 | Berger | F23R 3/14 | 60/39.23 |
| 5,557,920 | A | 9/1996 | Kain | | |
| 5,636,510 | A * | 6/1997 | Beer | F23R 3/14 | 60/39.23 |
| 5,647,215 | A * | 7/1997 | Sharifi | F23D 17/002 | 239/431 |
| 6,109,038 | A * | 8/2000 | Sharifi | F23C 6/042 | 60/737 |
| 6,679,063 | B2 | 1/2004 | Ebel | | |
| 7,721,545 | B2 | 5/2010 | Cayre et al. | | |
| 7,926,281 | B2 | 4/2011 | Commaret et al. | | |
| 10,041,681 | B2 | 8/2018 | Citeno et al. | | |
| 10,731,861 | B2 | 8/2020 | Schlein | | |
| 2005/0039458 | A1* | 2/2005 | Leen | F23C 7/004 | 60/748 |
| 2005/0144929 | A1* | 7/2005 | Jonsson | F23R 3/30 | 60/39.23 |
| 2007/0193274 | A1 | 8/2007 | Belsom | | |
| 2014/0060063 | A1* | 3/2014 | Boardman | F23R 3/286 | 60/737 |
| 2015/0369135 | A1 | 12/2015 | Laster et al. | | |
| 2017/0241337 | A1 | 8/2017 | Mokheimer et al. | | |
| 2017/0350598 | A1* | 12/2017 | Boardman | F23R 3/14 | |
| 2019/0032559 | A1* | 1/2019 | Dai | F23R 3/286 | |

FOREIGN PATENT DOCUMENTS

| | | | |
|---|---|---|---|
| FR | 2911666 | A1 | 7/2008 |
| FR | 3001283 | A1 | 7/2014 |
| FR | 3015638 | A1 | 6/2015 |

* cited by examiner

FUEL NOZZLE AND SWIRLER

CROSS REFERENCE TO RELATED APPLICATIONS

This application claims the benefit of U.S. Provisional Patent Application No. 63/298,784, filed on Jan. 12, 2022, which is incorporated herein by reference in its entirety.

TECHNICAL FIELD

The present subject matter relates generally to combustor for a turbine engine, the combustor having one or both of a fuel nozzle and a swirler.

BACKGROUND

An engine, such as a turbine engine, can include a turbine or other feature that is driven by combustion of a combustible fuel within a combustor of the engine. The engine utilizes a fuel nozzle to inject the combustible fuel into the combustor. A swirler provides for mixing the fuel with air in order to achieve efficient combustion.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
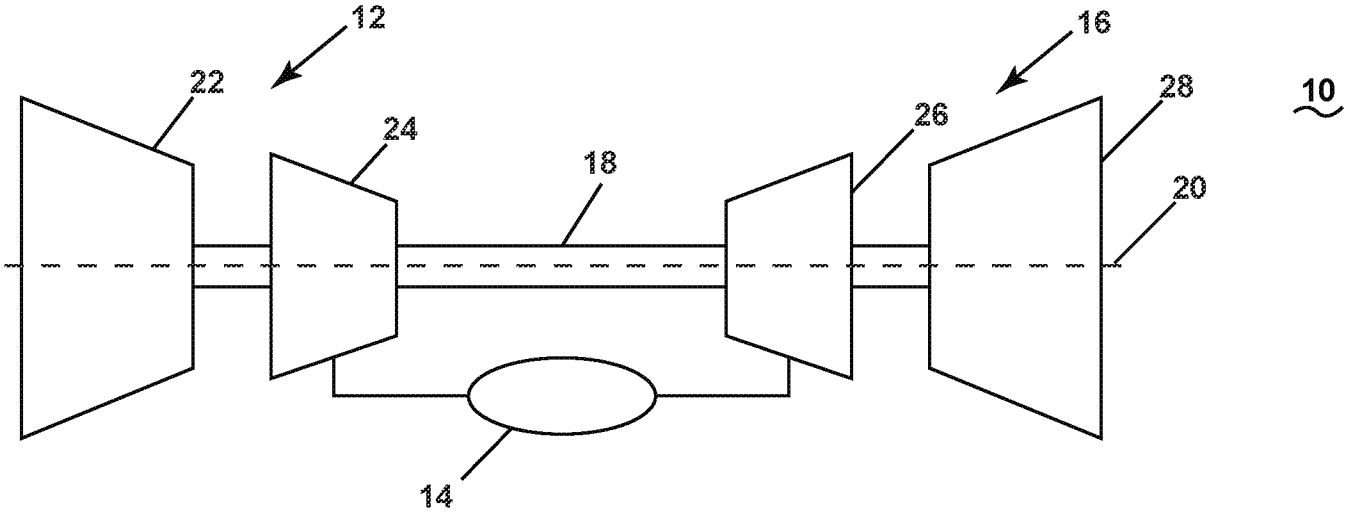
FIG. 1 is a schematic cross-sectional view of an engine in accordance with an exemplary embodiment of the present disclosure.

Aspects of the disclosure herein are directed to a fuel nozzle and swirler architecture located within an engine component, and more specifically to a fuel nozzle structure, nozzle cap structure, or swirler structure configured for use with heightened combustion engine temperatures, such as those utilizing a hydrogen fuel or hydrogen fuel mixes. Higher temperature fuels can eliminate carbon emissions, but generate challenges relating to flame holding or flashback due to the higher flame speed and high-temperatures. Current combustors include a durability risk when using such high-temperature fuels due to flame holding or flashback on combustor components. For purposes of illustration, the present disclosure will be described with respect to a turbine engine for an aircraft with a combustor driving the turbine. It will be understood, however, that aspects of the disclosure herein are not so limited.

During combustion, the engine generates high local temperatures. Efficiency and carbon emission needs require fuels that burn hotter than traditional fuels, or that reduced carbon emissions require the use of fuels with higher burn temperatures, like hydrogen fuel. For example, burn temperatures and burn speeds can be higher than that of current engine fuels, such that existing engine designs would include durability risks operating under the heightened temperatures required for heightened efficiency and emission standards.

Reference will now be made in detail to the fuel nozzle and swirler architecture, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

The term "flame holding" relates to the condition of continuous combustion of a fuel such that a flame is maintained along or near to a component, and usually a portion of the fuel nozzle assembly as described herein, and "flashback" relate to a retrogression of the combustion flame in the upstream direction. The term "flame scrubbing" relates to the condition of the combusted flame brushing against the inner or outer combustor liner, or other component.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, front, back, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, and connected) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about" and "generally" are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

The combustor introduces fuel from a fuel nozzle, which is mixed with air provided by a swirler, and then combusted within the combustor to drive the engine. Increases in efficiency and reduction in emissions have driven the need to use fuel that burns cleaner or at higher temperatures. There is a need to improve durability of the combustor under these operating parameters, such as improved flame control to prevent flame holding on the fuel nozzle and swirler components.

FIG. 1 is a schematic view of an engine as an exemplary turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor section 12 and turbine section 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include a HP turbine 26, and a LP turbine 28 serially fluidly coupled to one another. The drive shaft 18 can operatively couple the LP compressor 22, the HP compressor 24, the HP turbine 26 and the LP turbine 28 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
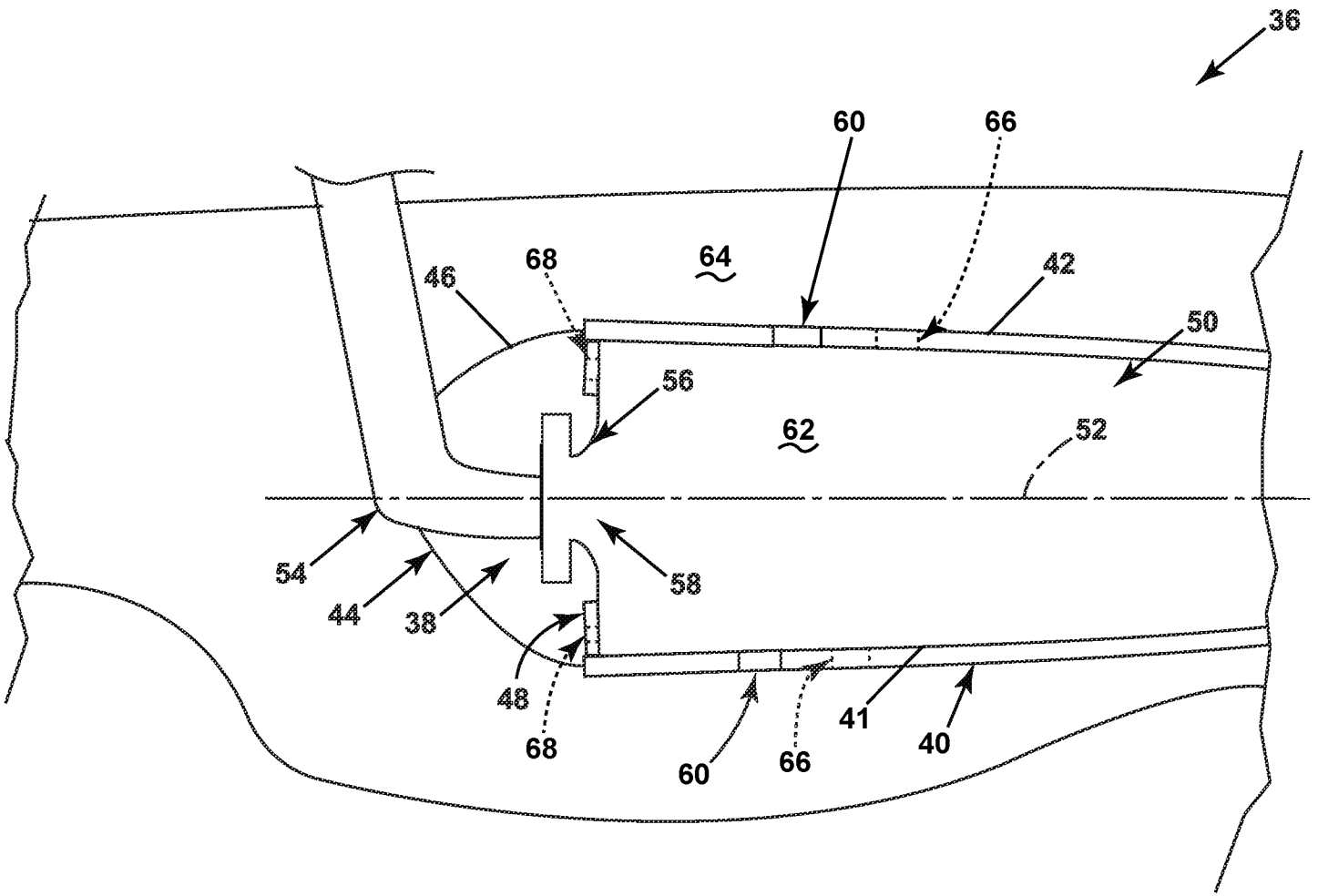
FIG. 2 is a schematic cross-sectional view of a combustor for the engine of FIG. 1 in accordance with an exemplary embodiment of the present disclosure.

FIG. 2 depicts a cross-section view of a combustor 36 suitable for use in the combustion section 14 of FIG. 1. The combustor 36 can include an annular arrangement of fuel nozzle assemblies 38 for providing fuel to the combustor. It should be appreciated that the fuel nozzle assemblies 38 can be organized in any arrangement, including an annular arrangement with multiple fuel injectors. The combustor 36 can have a can, can-annular, or annular arrangement depending on the type of engine in which the combustor 36 is located. The combustor 36 can include a combustor liner 40 having annular inner combustor liner 41 and an annular outer combustor liner 42, a dome assembly 44 including a dome 46 and a deflector 48, which collectively define a combustion chamber 50 about a longitudinal axis 52. At least one fuel nozzle 54 is fluidly coupled to the combustion chamber 50 to supply fuel to the combustor 36. The fuel nozzle 54 can be disposed within the dome assembly 44 upstream of a flare cone 56 to define a fuel outlet 58. A swirler can be provided at the dome assembly 44 to swirl incoming air in proximity to fuel exiting the fuel nozzle 54 and provide a homogeneous mixture of air and fuel entering the combustor 36.

A first set of dilution openings or a first set of dilution holes 60 can pass through the combustor liner 40. The first set of dilution holes 60 can extend from the annular outer combustor liner 42 to the annular inner combustor liner 41. That is, the first set of dilutions holes 60 fluidly connects an interior 62 of the combustion chamber 50 with an exterior 64 of the combustion chamber 50.

Optionally, a second set of dilution openings or a second set of dilution holes 66 can pass through the combustor liner 40. While illustrated as downstream of the first set of dilution holes 60, it is contemplated that the second set of dilution holes 66 can be upstream of the first set of dilution holes 60. It is further contemplated that any number of sets of dilutions holes can be included in the combustor liner 40.

Optionally, a set of dome dilution openings or a set of dome dilution holes 68 can pass through one or more portions of the dome assembly 44. While illustrated as extending through the deflector 48, any portion of the dome assembly 44 is contemplated.

Figure 3:
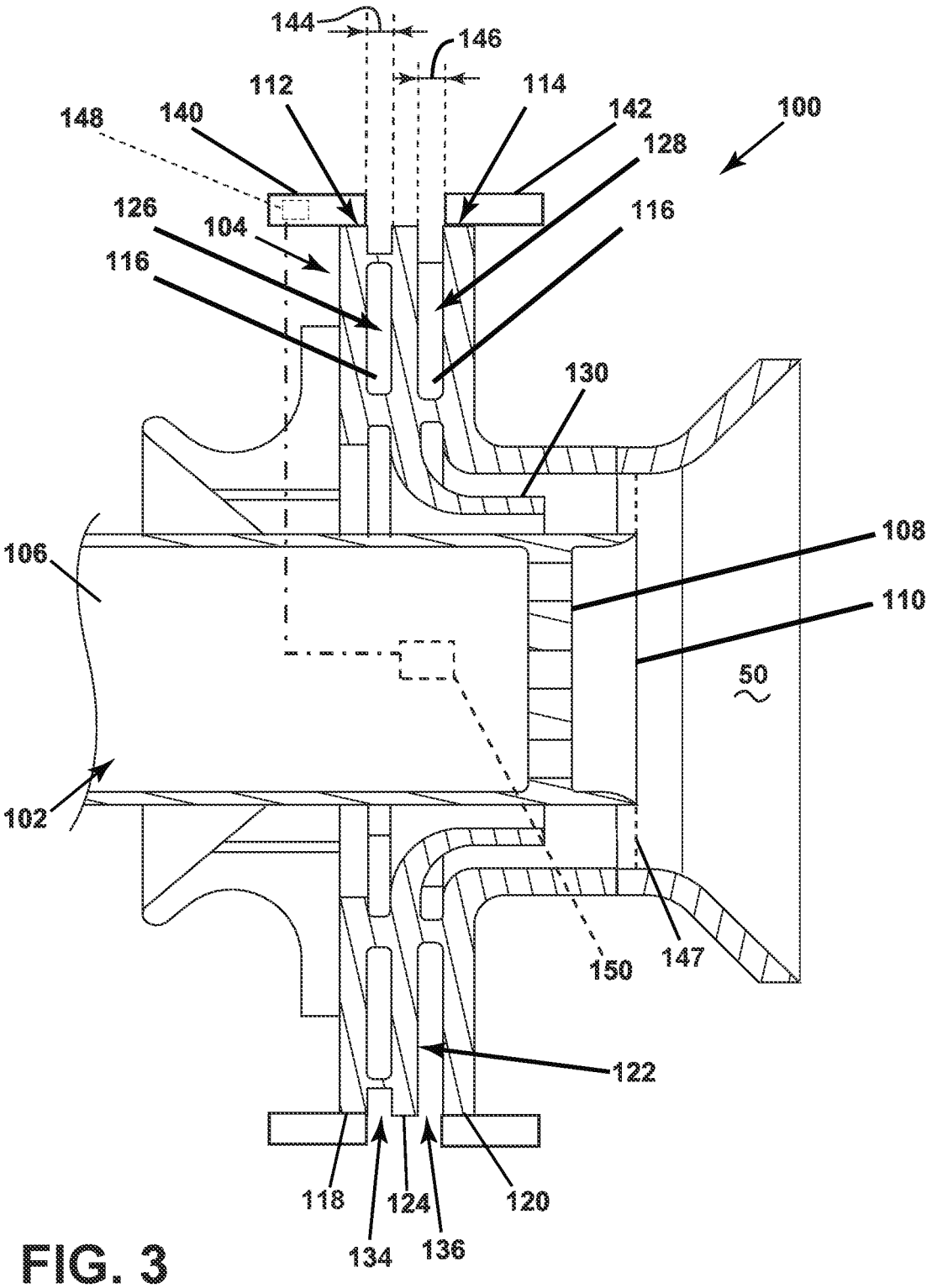
FIG. 3 is a cross-sectional view of a fuel nozzle assembly in accordance with an exemplary embodiment of the present disclosure.

FIG. 3 illustrates a fuel nozzle assembly 100, suitable for use in the combustor 36 as the fuel nozzle assembly 38 (FIG. 2), including a fuel nozzle 102 and a swirler assembly or swirler 104 circumscribing the fuel nozzle 102. The fuel nozzle 102 can define a fuel passage 106, with a nozzle cap 108 provided in the fuel passage 106 upstream of a nozzle tip 110. The swirler 104 includes a forward wall 112 and an aft wall 114, with a set of vanes 116 extending between the forward wall 112 and the aft wall 114. Alternatively, the set of vanes 116 can be two sets of vanes where a first set of vanes extend between the forward wall 112 and a central wall 122 and a second set of vanes extend between the central wall 122 and the aft wall 114. The set of vanes 116 can be provided at an angle, in order to impart a tangential or swirl component to airflow passing through the swirler 104. Optionally, the first set of vanes can impart a swirling motion in a first direction and the second set of vanes can impart a swirling motion in a second direction, opposite the first direction.

The fuel passage 106 can be a hydrogen fuel passage that provides hydrogen fuel or hydrogen fuel mixes to the combustion chamber 50.

The set of vanes 116 can be any structure that changes the direction of at least a portion of an airflow in the swirler 104. By way of example, the set of vanes 116 can be, a portion of a wall, a protrusion from the wall, a recess in the wall, or an airfoil shaped structure. The set of vanes 116 can have a leading edge and a trailing edge. The set of vanes 116 can have an airfoil shape similar to circumferentially-spaced stationary vanes located in the compressor section 12 or the turbine section 16.

A mouth can defined between leading edges of adjacent vanes of the set of vanes 116. An exit or vane exit can be defined by trailing edges of adjacent vanes. The set of vanes 116, therefore, form a set of circumferentially spaced mouths and a set of circumferentially spaced exits. The set of mouths can be fluidly coupled to the compressor section 12.

A forward outer surface 118 can be a portion of the forward wall 112 that is the farthest axially from the fuel passage 106. An aft outer surface 120 can be a portion of the aft wall 114 that is the farthest axially from the fuel passage 106.

The central wall 122, having a central outer surface 124, can separate the swirler 104 into a forward passage 126 and an aft passage 128, and the set of vanes 116 can be arranged as sets of vanes within each of the forward passage 126 and the aft passage 128. A splitter 130 extends aft of the central wall 122 at the trailing edge of the vanes 116.

A first inlet 134, fluidly coupled to the forward passage 126, can be defined by or between the forward outer surface 118 of the forward wall 112 and the central outer surface 124 of the central wall 122. A second inlet 136, fluidly coupled to the aft passage 128, can be defined by or between the central outer surface 124 of the central wall 122 and the aft outer surface 120 of the aft wall 114. The first inlet 134 and/or the second inlet 136 can be annular inlets or annular entrances to the swirler 104, where the annular inlets or annular entrances fluidly couple the compressor section 12 to the swirler 104.

At least one variable area device or adjustable flow adjuster can be located at or adjacent the first inlet 134 or the second inlet 136. The at least one flow adjuster can be any suitably structure or device that adjusts, varies, or alters the flow rate of pressurized air from the HP compressor section 24 to the combustion chamber 50. It is contemplated that the least one flow adjuster can vary the flow rate into or through at least a portion of the swirler 104.

The at least one flow adjuster can be located adjacent the first inlet 134 or second inlet 136. The at least one variable area device or adjustable flow adjuster is illustrated, by way of example, as a first movable wall 140 and a second movable wall 142. The first movable wall 140 is located at the forward outer surface 118 and can be moved axially towards the central outer surface 124. As the first movable wall 140 is adjusted or moved towards the central outer surface 124, an effective area of the first inlet 134 decreases. The term "effective area" as used herein can be equal to or proportionate to the minimum cross-sectional area of one or more portions of the air circuit through the swirler 104. The air circuit can include, by way of non-limiting example, one or more of the first inlet 134, the second inlet 136, the forward passage 126, the aft passage 128, or portion of the swirler 104 at or upstream of the nozzle tip 110 or the combustion chamber 50. The term "effective area" can further be interpreted as equal to or proportionate to the minimum cross-sectional area of one or more portions of a set of dilutions holes.

The effective area of the first inlet 134 can depend on a first diameter 144 measured from the central wall 122 axially to the first movable wall 140.

The second movable wall 142 is located at the aft outer surface 120 and can be slid or moved axially towards the central outer surface 124. As the second movable wall 142 is adjusted, slid, or otherwise moved towards the central outer surface 124, an effective area of the second inlet 136 decreases. The effective area of the second inlet 136 can depend on a second diameter 146 measured from the central wall 122 axially to the second movable wall 142.

The first movable wall 140 and the second movable wall 142 can define a pair of opposing walls. It is contemplated that the first movable wall 140 and the second movable wall 142 can lie on axially opposite sides of the first inlet 134 and the second inlet 136. It is further contemplated that the first movable wall 140 and the second movable wall 142 can lie on axially opposite sides of the same inlet. The first movable wall 140 and the second movable wall 142 can be moved toward each other or can be moved in the same axial direction.

The velocity of the air flow mixing with the fuel can be controlled using the first movable wall 140 or the second movable wall 142. It is contemplated that adjusting the first movable wall 140 or the second movable wall 142 can be used to change a pressure drop. That is, the first movable wall 140 or the second movable wall 142 can be used to achieve a predetermined or tailored pressure drop. The pressure drop can be between the first inlet 134 or the second inlet 136 and an annular exit or exit 147 where the swirler 104 is fluidly coupled to the combustion chamber 50. It is further contemplated that adjusting the first movable wall 140 or the second movable wall 142 can be used to change a volumetric flow rate or direction of the air flow mixing with the fuel.

While illustrated as the first movable wall 140 and second movable wall 142, the at least one adjustable flow adjuster can be any shape that can block one or more portions of the first inlet 134 or the second inlet 136 via a linear motion or an angular motion. That is, it is contemplated that the at least one adjustable flow adjuster can be a rotatable flow adjuster. While two inlets and two flow adjusters are pictured, any number of inlets or flow adjusters are contemplated.

While illustrated as a radial-radial flow, it is contemplated that the swirler 104 can be an axial-radial swirler or any known swirler where the at least one adjustable flow adjuster can block one or more portions of at least one inlet to passages defined by the swirler.

The at least one adjustable flow adjuster can be controlled using one or more of an external or internal actuation mechanism, such as, but not limited to, a hydraulic ram or an electronic motor 148.

A sensor 150 can be located in the fuel passage 106. The sensor 150 can be a flow meter. The sensor 150 can provide an output indicative of the flow of fluid through the fuel passage 106. The variable area device or adjustable flow adjuster can be automatically adjusted based a flow of fluid in the fuel passage 106 as measured or determined by the sensor 150. Additionally, or alternatively, the sensor 150 can measure or provide an output indicative a pressure drop across one or more portions of the swirler 104. For example, the sensor 150 could provide a pressure drop between the first inlet 134 or the second inlet 136 and the exit 147 or the combustion chamber 50. While illustrated as the pressure drop between the first inlet 134 or the second inlet 136 and the exit 147, the pressure drop can be measured between any point in the swirler 104 and another point in the swirler 104 or anywhere in the combustion chamber 50.

The actuation of the least one adjustable flow adjuster can result from one or more outputs of the sensor 150. That is, the first movable wall 140 or the second movable wall 142 can be automatically adjusted based on the fuel flow or pressure drop determined by the sensor 150.

It is contemplated that the sensor 150 can function as an actuator, where the output of the sensor is a physical motion initiated by the sensor 150 and communicated, for example by linkages, to the first movable wall 140 or the second movable wall 142. That is, the sensor 150 can directly control the effective area of the first inlet 134 or the second inlet 136 based on the fuel flow or the pressure difference.

While illustrated as a single sensor 150, any number of sensors adjacent to or located within the fuel nozzle assembly 100 are contemplated.

A typical inline valve would not work as the at least one adjustable flow adjuster because of the large annular flow to the combustor from the HP compressor section 24. That is, flow from the HP compressor section 24 cannot be contained in a simple pipe with an inline valve. The at least one flow adjuster must be able to handle a high volume airflow from the HP compressor section 24 (FIG. 1) and selectively provide the first inlet 134 or the second inlet 136 with the compressed air.

Figure 4:
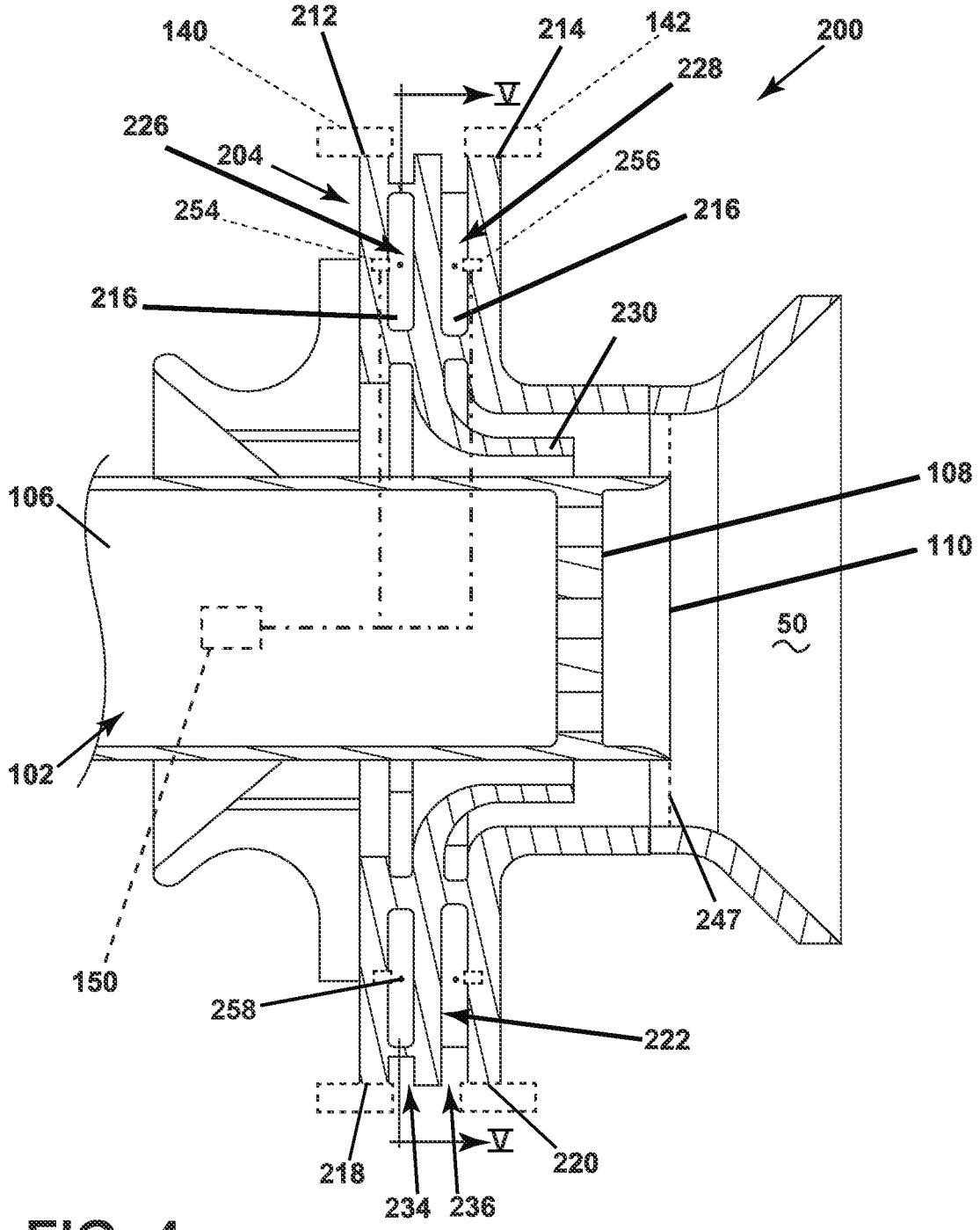
FIG. 4 is a variation of the fuel nozzle assembly of FIG. 3 in accordance with an exemplary embodiment of the present disclosure.

FIG. 4 illustrates a fuel nozzle assembly 200, suitable for use in the combustor 36 as the fuel nozzle assembly 38 (see FIG. 2). The fuel nozzle assembly 200 is similar to the fuel nozzle assembly 100, where slightly differing portions are increased by a hundred. The fuel nozzle assembly 200 includes the fuel nozzle 102 and a swirler 204 circumscribing the fuel nozzle 102. The fuel nozzle 102 defines the fuel passage 106, with the nozzle cap 108 provided in the fuel passage 106 upstream of the nozzle tip 110. The swirler 204 includes an annular forward wall 212 and an annular aft wall 214, with a set of vanes 216 extending between the forward wall 212 and the aft wall 214.

A central wall 222 can separate the swirler 204 into a forward passage 226 and an aft passage 228, and the vanes 216 can be arranged as sets of vanes within each of the forward passage 226 and the aft passage 228. A splitter 230 can extend aft of the central wall 222 at the trailing edge of the vanes 216.

The at least one variable area device or adjustable flow adjuster is illustrated, by way of example, as the set of vanes 216 and one or more actuators that pivot at least one vane of the set of vanes 216. That is, the set of vanes 216 can couple to one or more actuators. The one or more actuators are illustrated, by way of example as a first actuator 254 and a second actuator 256. The first actuator 254 is illustrated, by way of example, as locate at least partially within the forward wall 212, while the second actuator 256 is illustrated, by way of example, as located at least partially within the aft wall 214. Other locations for the one or more actuators are contemplated, such as, but not limited to, within the set of vanes 216, the central wall 222, exterior portions of the forward wall 212, or exterior portions of the aft wall 214. The one or more actuators can also be located outside the turbine engine 10, using linkages (i.e. rods, cables, or bars) to communicate with the vanes 216.

The first actuator 254 or the second actuator 256 can rotate one or more of the set of vanes 216 about a pivot 258. The first actuator 254 and the second actuator 256 can rotate one or more of the set of vanes 216 about the pivot 258. That is, the first actuator 254 and/or the second actuator 256 can rotate one or more of the set of vanes 216 by applying a force on one or more portions of the set of vanes 216 at a non-zero distance from the pivot 258 that results in rotation about the pivot 258. While illustrated as centrally located on each vane of the set of vanes 216, the pivot 258, any location on each vane, including differing locations from one vane to another vane, are contemplated.

The rotation of one or more of the set of vanes 216 can change the effective area of the forward passage 226, a first inlet 234 of the forward passage 226, the aft passage 228, or a second inlet 236 of the aft passage 228. That is, the set of vanes 216 can be a variable area device. Additionally, the velocity of the air flow mixing with the fuel can be at least partially controlled by the rotation of one or more of the set of vanes 216.

The adjustment of the set of vanes 216 via the first actuator 254 and the second actuator 256 can be used to change a pressure drop. The pressure drop can be, by way of example, between the first inlet 234 or the second inlet 236 and an exit 247 where the swirler 204 fluidly coupled to the combustion chamber 50.

It is contemplated that the adjustment of the set of vanes 216 via the first actuator 254 or the second actuator 256 can be automatic based on output from the sensor 150. The output from the sensor 150 can be indicative of the fuel flow rate in the fuel passage 106 or the pressure drop between one or more portions of the swirler 204 and the combustion chamber 50. If is further contemplated that the adjustment of the set of vanes 216 via the first actuator 254 or the second actuator 256 can be determined by one or more controllers based on the output of the sensor 150.

Optionally, the fuel nozzle assembly 200 can include the first movable wall 140 and the second movable wall 142. The first movable wall 140 or the second movable wall 142 can be controlled by the sensor 150 or moved based on an output provided by the sensor 150.

Figure 5:
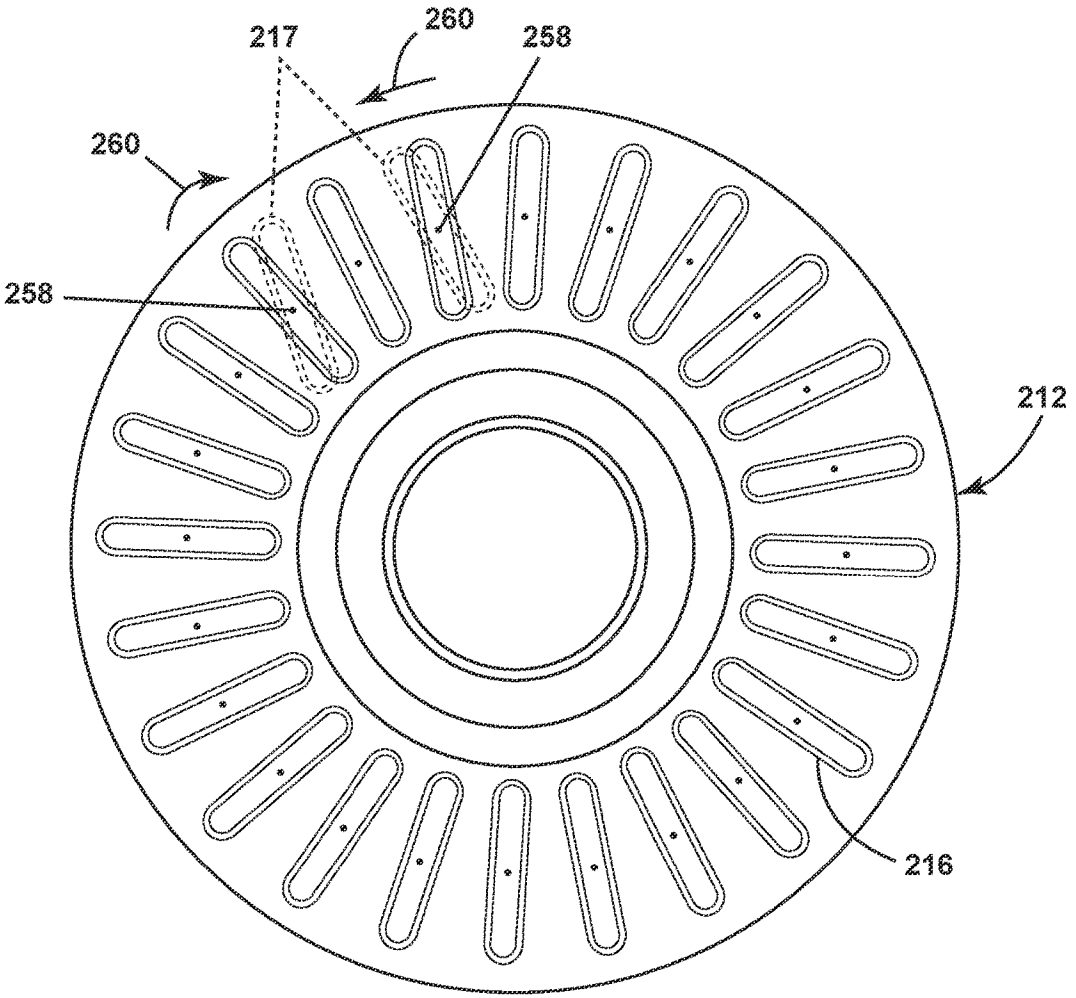
FIG. 5 is a section view taken across section V-V of FIG. 4 in accordance with an exemplary embodiment of the present disclosure.

Turning to FIG. 5, taken along section V-V of FIG. 4, between the forward wall 212 and the central wall 222, showing the set of vanes 216 that have a radial arrangement relative to the forward wall 212. The set of vanes 216 can rotate, for example, about the pivot 258 as indicated by arrows 260 and illustrated by phantom rotated vanes 217. The set of vanes 216 can be individually controlled or move together. That is, the variable area device can separately pivot a single vane or a subset of vanes of the set vanes 216 through an arc different than that of the remainder of the set of vanes 216. The each of the vanes of the set of vanes 216 can rotate clockwise or counterclockwise through an arc to vary the effective area of the forward passage 226 or the aft passage 228 upstream of the exit 247.

Figure 6:
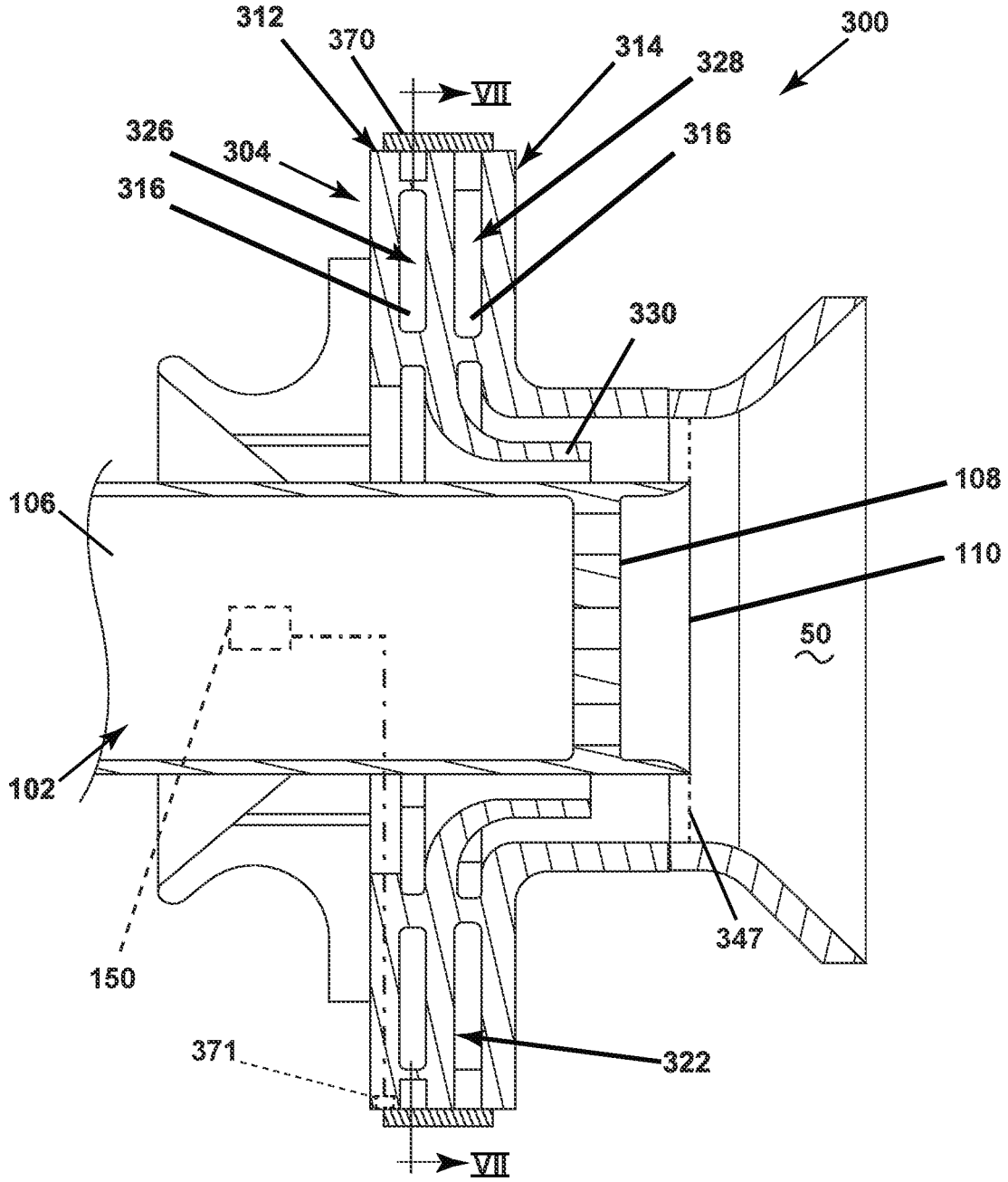
FIG. 6 is another variation of the fuel nozzle assembly of FIG. 3 in accordance with an exemplary embodiment of the present disclosure.

FIG. 6 illustrates a fuel nozzle assembly 300, suitable for use in the combustor 36 as the fuel nozzle assembly 38. The fuel nozzle assembly 300 is similar to the fuel nozzle assembly 100 of FIG. 3 and the fuel nozzle assembly 200 of FIG. 4, where slightly differing portions are increased by a hundred. The fuel nozzle assembly 300 includes the fuel nozzle 102 and a swirler 304 circumscribing the fuel nozzle 102. The fuel nozzle 102 can define the fuel passage 106, with the nozzle cap 108 provided in the fuel passage 106 upstream of the nozzle tip 110. The swirler 304 includes an annular forward wall 312 and an annular aft wall 314, with a set of vanes 316 extending between the forward wall 312 and the aft wall 314.

A central wall 322 can separate the swirler 304 into a forward passage 326 and an aft passage 328, and the set of vanes 316 can be arranged within each of the forward passage 326 and the aft passage 328. A splitter 330 can extend aft of the central wall 322 at the trailing edge of the set of vanes 316.

Figure 7:
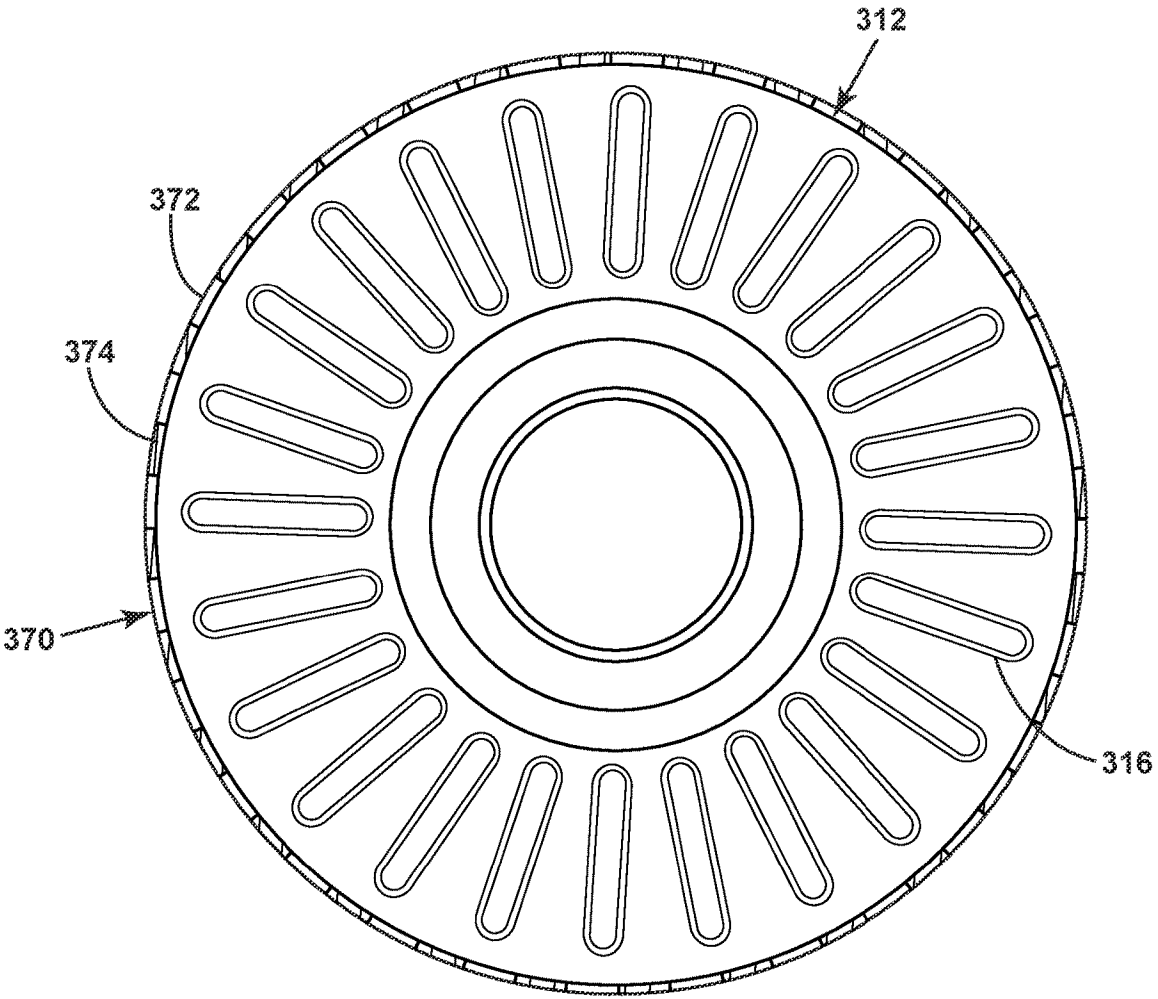
FIG. 7 is a section view taken across section VII-VII of FIG. 6 in accordance with an exemplary embodiment of the present disclosure.

The set of vanes 316 can be circumscribed by a baffle illustrated as a perforated ring 370 that includes at least one opening or window 372 (see FIG. 7). Flow to a first inlet 334 of the forward passage 326 and a second inlet 336 of the aft passage 328 can be controlled by the perforated ring 370. Alternately, the perforated ring 370 can be more than one baffle or perforated ring, where a first perforated ring controls the flow through the first inlet 334 of the forward passage 326 and a second perforated ring can control the flow through the second inlet 336 of the aft passage 328. That is, any number of baffles or perforated rings is contemplated.

Optionally, the perforated ring 370 can be rotated or move axially. The rotation or axial motion of the perforated ring 370 can change the effective area of the first inlet 334 of the forward passage 326 or the second inlet 336 of the aft passage 328. That is, the perforated ring 370 is a variable area device. The velocity of the air flow mixing with the fuel can be at least partially controlled by the rotation or movement of the perforated ring 370.

Additionally, or alternatively, adjustment of the perforated ring 370 can be used to change a pressure drop. The pressure drop can be, for example, between the first inlet 334 or the second inlet 336 and an exit 347 where the swirler 304 fluidly coupled to the combustion chamber 50.

While illustrated as exterior of the forward passage 326 and the aft passage 328, it is contemplated that one or more portions, or the entirety of the perforated ring 370 is located within the forward passage 326 and the aft passage 328.

Optionally an actuator 371 can interface with the perforated ring 370. The actuator 371 can be in direct communication with or directly controlled by the sensor 150. The output from the sensor 150 can be indicative of the fuel flow rate in the fuel passage 106 or the pressure drop between one or more portions of the swirler 304 and the combustion chamber 50. The actuator 371 or sensor 150 can automatically adjust the perforated ring 370 or provide an output used to adjust the perforated ring 370.

Additionally, or alternatively, the actuator 371 can be in commutation with one or more controllers. It is contemplated that the actuator 371 can rotate or move the perforated ring 370 with respect to the first inlet 334 or the second inlet 336. It is further contemplated that the actuator 371 can adjust the effective area of at least one opening or window 372 (see FIG. 7).

Turning to FIG. 7, taken along section VII-VII of FIG. 6, between the forward wall 312 and the central wall 322, showing the set of vanes 316 that have a radial arrangement relative to the forward wall 312. The perforated ring 370 can be used to control the effective area of the first inlet 334 or the second inlet 136 (FIG. 6). Optionally, the actuator 371 can control the perforated ring 370 as it rotates relative to the first inlet 334 or the second inlet 136. As it rotates, the perforated ring 370 can control the effective area of the first inlet 334 or the second inlet 136 as it moves from a solid portion 374 of the perforated ring 370 to an open portion such as the at least one window 372. Similarly, the velocity of the air flow mixing with the fuel can be controlled by the rotation or rotational speed of the perforated ring 370.

Additionally, or alternatively, adjustment of the size of the window 372 or the speed of rotation of the perforated ring 370 can be used to change control a pressure drop. That is, the windows 372, as illustrated by way of example, can be equally spaced or equally sized. Alternatively, one or more of the spacing or size can change from one window 372 to another. Further, it is contemplated that structures can be added to the perforated ring 370 that change the size of the windows 372.

Figure 8:
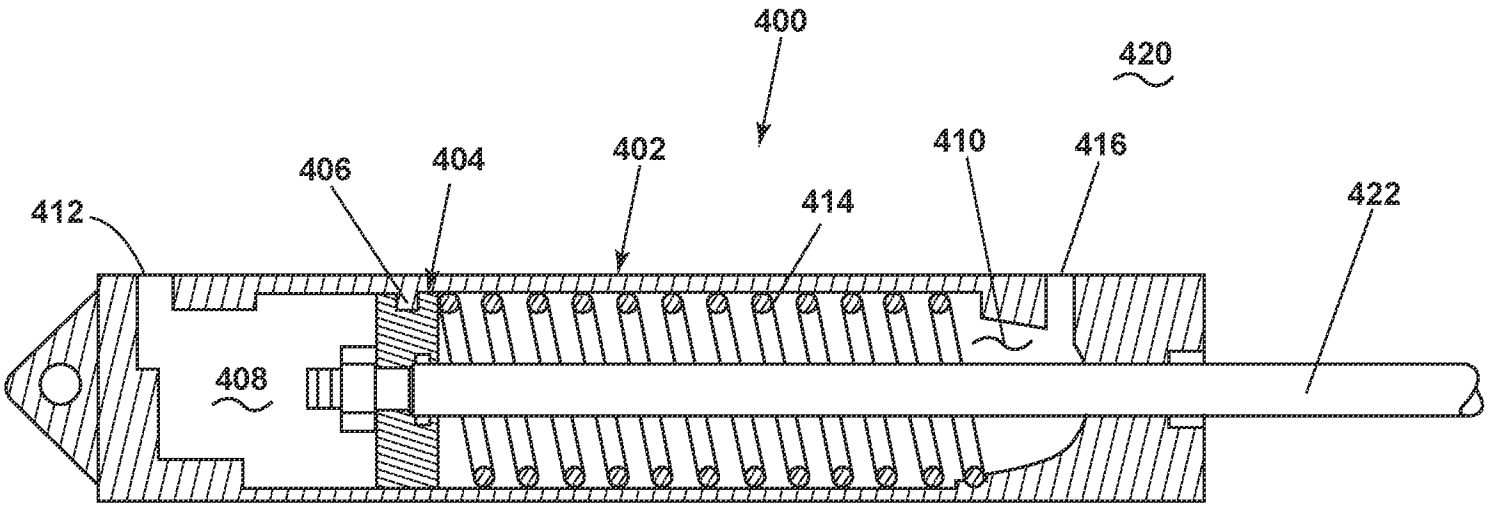
FIG. 8 is a cross-section view of an actuator for the fuel nozzle assembly of FIG. 3, FIG. 4 or FIG. 6 in accordance with an exemplary embodiment of the present disclosure.

FIG. 8 illustrates a sensor or an actuator 400 that can be used as or coupled to any of the sensors or the actuators as described herein. The actuator 400 can include a housing 402 that circumscribes a piston 404. A piston seal 406 can fluidly isolate a first chamber 408 from a second chamber 410. A fluid inlet/outlet 412 can extend through the housing 402 and fluidly couple the first chamber 408 to a fluid source. The fluid source can be the fuel passage 106 or separate fluid reservoir (not shown).

The piston 404 can have a position restoration device such as a spring 414. The spring 414 can be located in the second chamber 410 and circumscribe at least a portion of the piston 404. The second chamber 410 can be a dry chamber, that is, the second chamber 410 can include air as the fluid through with the components articulate. An air vent 416 can fluidly couple the second chamber 410 to an exterior 420 of the housing 402.

A piston rod 422, driven by the fluid pressure in the first chamber 408 can be coupled to one or more components that control the effective area or pressure difference of the fuel nozzle 102. That is, the piston rod 422 can be used to control one or more elements at or adjacent to the first inlet 134, 234, 334 or second inlet 136, 236, 336 of the swirler 104, 204, 304 of FIGS. 3-6.

When the fluid pressure in the first chamber 408 increases, the piston 404 can be driven to compress the spring 414 within the second chamber 410. This extends the piston rod 422. When the fluid pressure in the first chamber 408 decreases, the spring 414 restores the position of the piston rod 422 and the volume of the fluid in the first chamber 408 decreases.

It is contemplated that one or more portions of the actuator 400 can be in communication with or included in the sensor 150 or the fuel passage 106 of FIGS. 3-6.

Figure 9A:
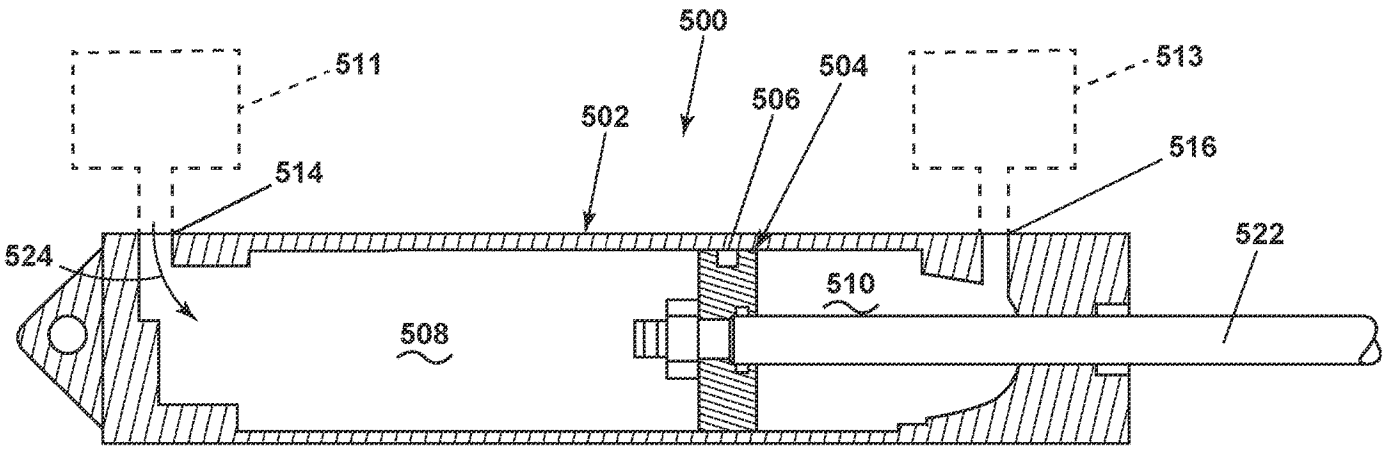
FIG. 9A-9B is a variation of the actuator of FIG. 8 in accordance with an exemplary embodiment of the present disclosure.

FIG. 9A illustrates a sensor or an actuator 500 that can be used or coupled to any of the sensors or the actuators as described herein. The actuator 500 can include a housing 502 that circumscribes a piston 504. A piston seal 506 can fluidly isolate a first chamber 508 from a second chamber 510. A first fluid inlet/outlet 512 can extend through the housing 502 and fluidly couple the first chamber 508 to a fluid source. The fluid source can be the fuel passage 106 or a first fluid reservoir or first reservoir 511. A second fluid inlet/outlet 516 can extend through the housing 502 and fluidly couple the second chamber 510 to a fluid source, illustrated as a second fluid reservoir or second reservoir 513. One or more pumps (not shown) can be located at or between the first reservoir 511 and the first inlet/outlet 514. Optionally, one or more additional pumps can be located at or between the second reservoir 513 and the second fluid inlet/outlet 516.

A piston rod 522, can be driven by the volume of fluid or fluid pressure in the first chamber 508 or the second chamber 510. As illustrated, by way of example, fluid 524 can enter the first chamber 508. The fluid 524 can be pumped into the first chamber 508 from the first reservoir 511 or be forced into the first chamber 508 due to an increase in pressure in the first reservoir 511. As the volume or pressure of the fluid in the first chamber 508 increases, the piston 504 is forced towards the second chamber 510. This decreases the volume of the second chamber 510 and can force fluid from the second chamber 510 into the second reservoir 513.

Alternately, the piston 504 can be drawn towards the second chamber 510 when fluid from the second chamber 510 is drawn into the second reservoir 513 by a pump or change in pressure of the second reservoir 513. The resulting increase in volume of the first chamber 508 could draw fluid from the first reservoir 511 into the first chamber 508.

Figure 9B:
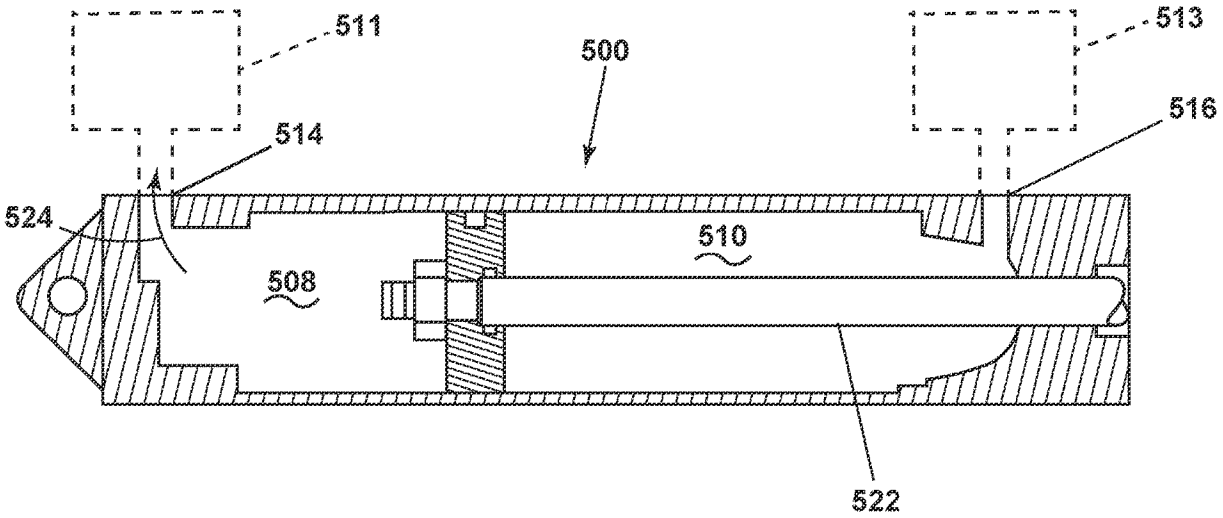

FIG. 9B shows the actuator 500 in an alternate situation in which the piston 504 is drawn towards the first chamber 508. As illustrated, by way of example, fluid 524 can leave the first chamber 508. The fluid 524 can be pumped out of the first chamber 508 and into the first reservoir 511 or be forced into the first reservoir 511 due to an increase in pressure in the first chamber 508. As the volume of the fluid in the first chamber 508 decreases, the piston 504 is moves towards the first chamber 508. This increase the volume of the second chamber 510 and can force fluid from the second reservoir 513 into the second chamber 510.

Alternately, the piston 504 can be drawn towards the first chamber 508 when fluid from the second reservoir 513 is pumped or drawn into the second chamber 510 by a pump or change in pressure of the second reservoir 513. The resulting increase in volume of the second chamber 510 could result in fluid from the first chamber 508 being forced into the first reservoir 511.

Whether drawn towards the first chamber 508 or towards the second chamber 510, the piston 504 can move the piston rod 522 as desired from a controller or information from one or more sensors, such as sensor 150 (FIGS. 3, 4, and 6). The piston rod 522 can be coupled to one or more components that control the effective area or pressure difference of the fuel nozzle 102. That is, the piston rod 522 can be used to control one or more elements at or adjacent to the first inlet 134, 234, 334 or second inlet 136, 236, 336 of the swirler 104, 204, 304 of FIGS. 3-6.

Figure 10:
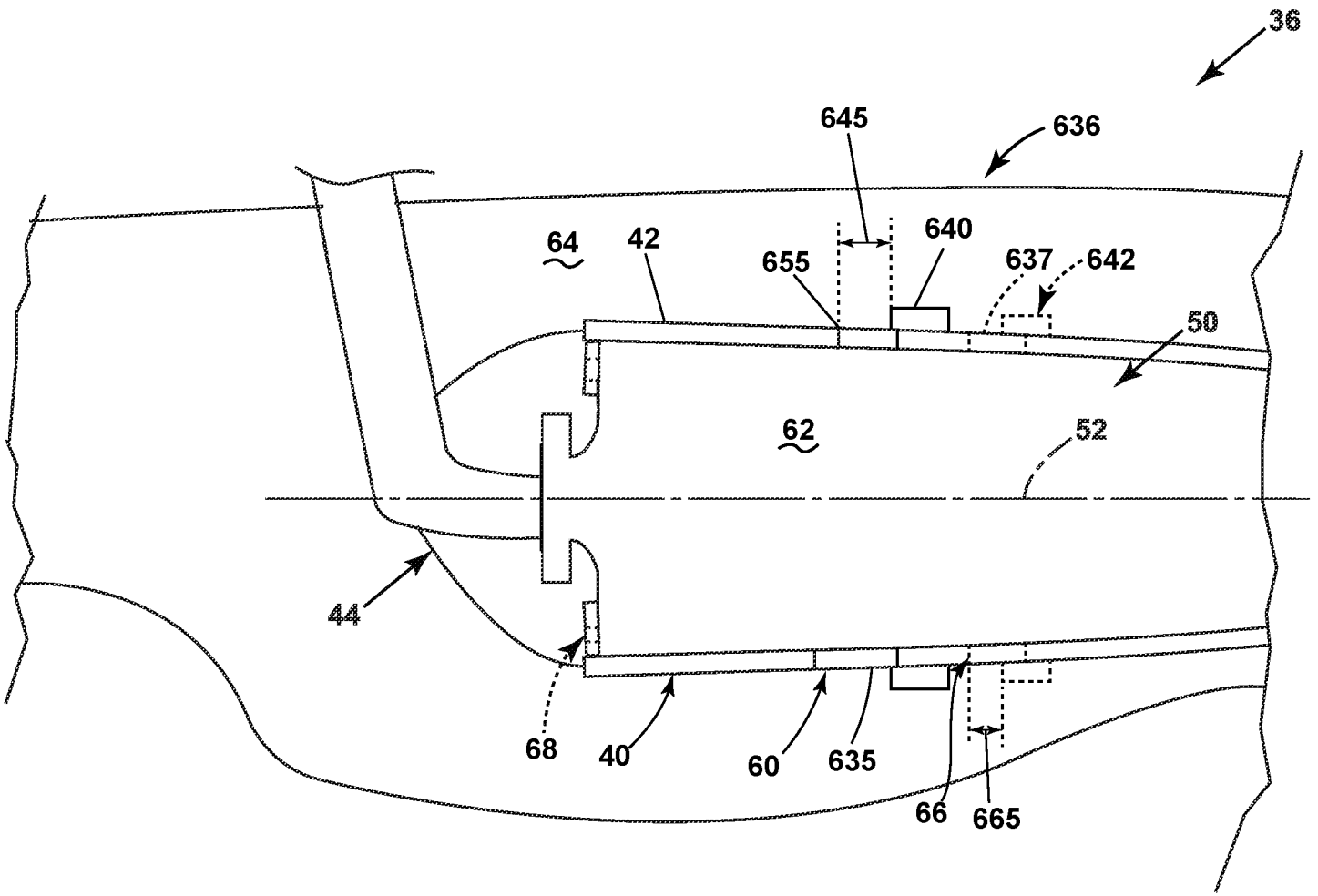
FIG. 10 is a variation of the combustor of FIG. 2 in accordance with an exemplary embodiment of the present disclosure.

FIG. 10 depicts a cross-section view of a combustor 636 suitable for use in the combustion section 14 of FIG. 1. The combustor 636 is similar to the combustor 36 of FIG. 2, where the combustor 636 includes at least one flow adjuster that can be located adjacent the first set of dilution holes 60. The at least one variable area device or adjustable flow adjuster is illustrated, by way of example, as a first movable wall 640. The first movable wall 640 is located at the annular outer combustor liner 42 of the combustor liner 40 adjacent the first set of dilution holes 60. The first movable wall 640 can be moved axially. That is, the first movable wall 640 can be moved back and forth along the surface of the annular outer combustor liner 42. As the first movable wall 640 is adjusted or moved to cover a first inlet 635 of the first set of dilution holes 60, an effective area of the first inlet 635 decreases.

The effective area of the first inlet 635 can depend on a first diameter 645 measured axially from the first movable wall 640 to an opposite sidewall 655 of first set of dilution holes 60. While illustrated as downstream of the first inlet 635, it is contemplated that the first movable wall 640 can be upstream of the first inlet 635.

Optionally, a second movable wall 642 can be located at the annular outer combustor liner 42 of the combustor liner 40 adjacent the second set of dilution holes 66. As the second movable wall 642 is adjusted, slid, or otherwise moved, it can at least partially cover a second inlet 637 of the second set of dilution holes 66. As the second movable wall 642 covers at least a portion of the second inlet 637, an effective area of the second inlet 637 decreases. The effective area of the second inlet 637 can depend on a second diameter 665 measured axially from a leading edge of the second movable wall 642 to the side of the second inlet 637 farthest from the second movable wall 642.

The first inlet 635 or the second inlet 637 can be annular inlets or an annular entrance to the combustion chamber 50, where the annular inlets or annular entrances fluidly couple the compressor section 12 to the combustion chamber 50.

The first movable wall 640 and the second movable wall 642 can define a pair of opposing walls. It is contemplated that the first movable wall 640 and the second movable wall 642 can lie on axially opposite sides of the first inlet 635 and the second inlet 637. It is further contemplated that the first movable wall 640 and the second movable wall 642 can lie on axially opposite sides of the same inlet. The first movable wall 640 and the second movable wall 642 can be slid or moved toward each other or can be moved in the same axial direction.

It contemplated that the first movable wall 640 and the second movable wall 642 can be controlled, actuated, or move together. Alternatively, the first movable wall 640 and the second movable wall 642 can move, be actuated, or otherwise controlled independently. Further, the control of the first movable wall 640 or the second movable wall 642 can depend on one or more sensors in one or more portions of the combustor 36, including, but not limited to, the swirler 104 (see FIG. 3).

While illustrated adjacent to the first set of dilution holes 60 in the combustor liner 40, it is contemplated that at least the first movable wall 640 can be used to control an effective area of the set of dome dilution holes 68. That is, the any number of movable walls can move radially, axially, or at an angle relative to the longitudinal axis 52 to alter the effective area of any one or more sets of dilution holes.

Figure 11:
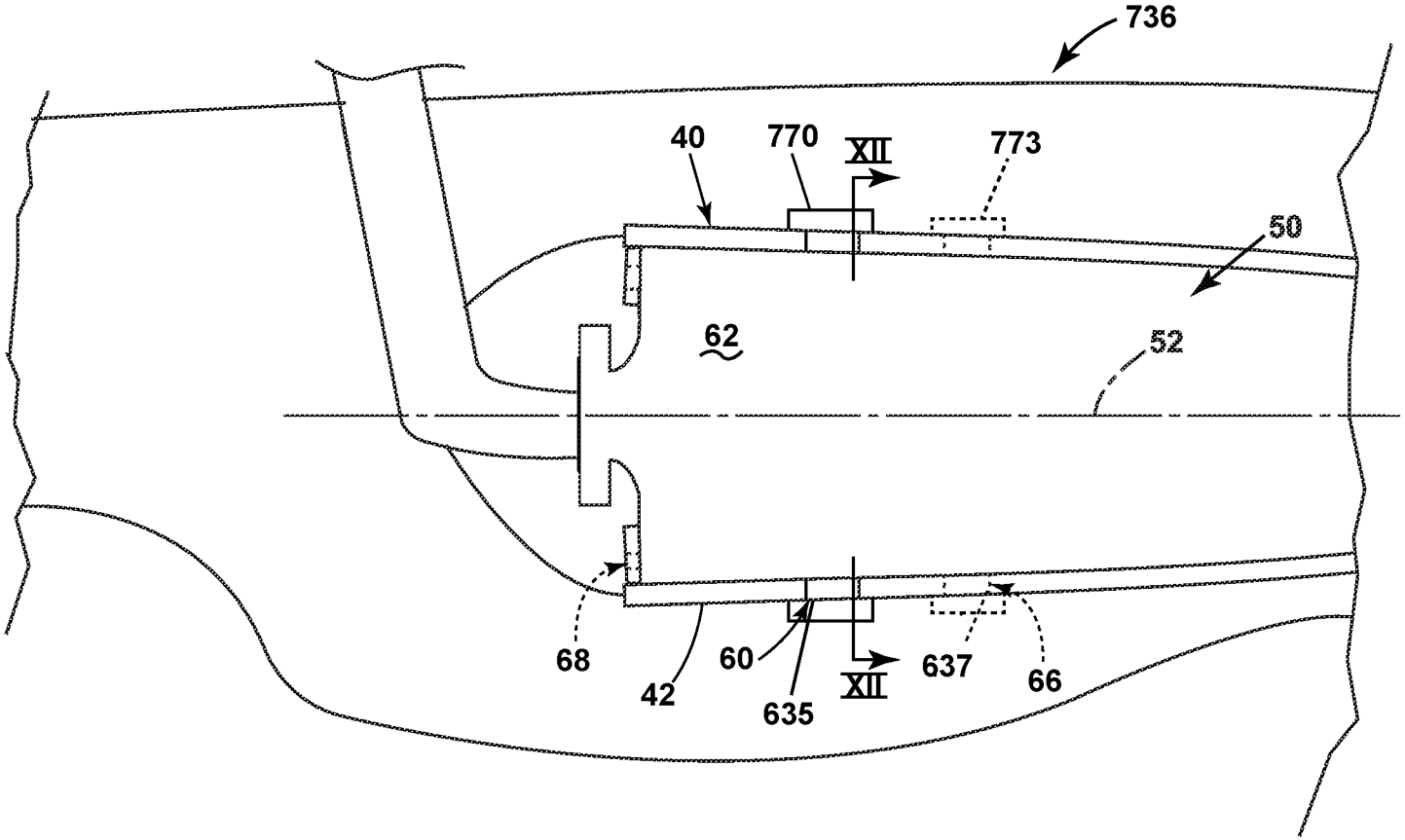
FIG. 11 is another variation of the combustor of FIG. 2 in accordance with an exemplary embodiment of the present disclosure.

FIG. 11 depicts a cross-section view of a combustor 736 suitable for use in the combustion section 14 of FIG. 1. The combustor 736 is similar to the combustor 636, where slightly differing portions are increased by a hundred.

Flow to a first inlet 635 of the first set of dilution holes 60 can be controlled by a first baffle or first perforated ring 770. Optionally, a second baffle or a second perforated ring 773 can control the flow through the second inlet 637. Alternatively, a single baffle or perforated ring can control the flow through the first inlet 635 and the second inlet 637. That is, any number of baffles or perforated rings are contemplated.

Optionally, the first perforated ring 770 can be rotated or move axially. The rotation or axial motion of the first perforated ring 770 can change an effective area of the first inlet 635. Similarly, the second perforated ring 773 can be moved axially or rotated to control an effective area of the second inlet 637. That is, the first perforated ring 770 and the second perforated ring 773 are examples of a variable area device.

It is contemplated that the first perforated ring 770 or the second perforated ring 773 can be controlled, actuated, or move together. Alternatively, the first perforated ring 770 and the second perforated ring 773 can move, be actuated, or otherwise controlled independently. It is contemplated that the first perforated ring 770 or the second perforated ring 773 can rotate about the longitudinal axis 52. The speed or angle of rotation of the first perforated ring 770 or the second perforated ring 773 can be controlled or adjusted by a controller (not shown) or any combination of sensors or actuators.

While illustrated adjacent to the first set of dilution holes 60 in the combustor liner 40, it is contemplated that at least the first perforated ring 770 can be used to control an effective area of the set of dome dilution holes 68. That is, the any number of perforated rings that can rotate from a solid portion to an open window relative to the longitudinal axis 52 can be used to control an effective area of one or more sets of openings or dilution holes in the combustor 736.

Figure 12:
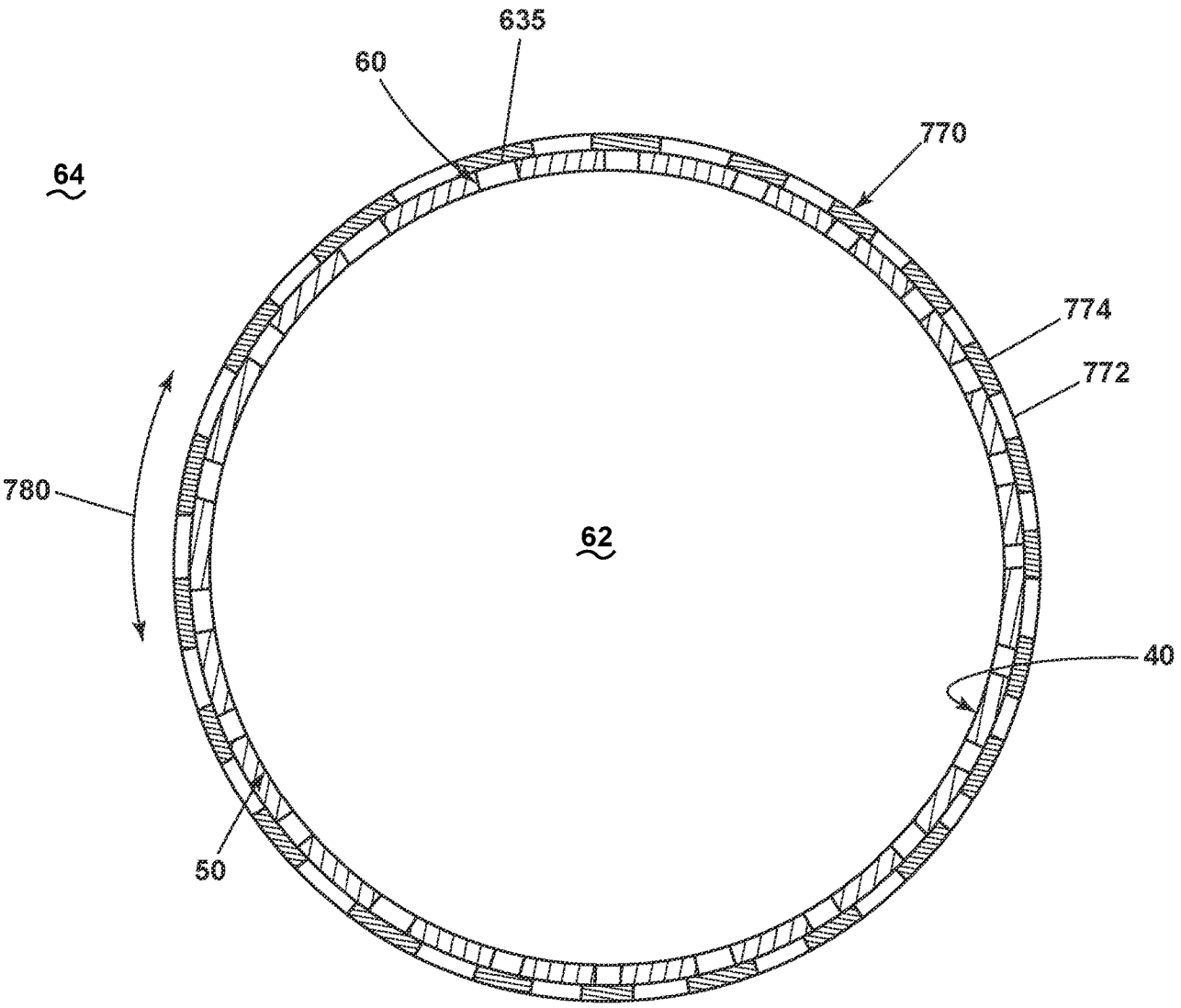
FIG. 12 is a section view taken across section XII-XII of FIG. 11 in accordance with an exemplary embodiment of the present disclosure.

Turning to FIG. 12, taken along section XII-XII of FIG. 11, at the first set of dilution holes 60. The first perforated ring 770 can be used to control the effective area of the first inlet 635. The first perforated ring 770 can control the effective area of the first inlet 635 as it rotates, as indicated by arrow 780, from a solid portion 774 of the first perforated ring 770 to an open portion such as the at least one window 772. The circumferentially spaced windows 772 can circumscribe the at least one annular entrance or the first inlet 635. The rotation of the first perforated ring 770 can be clockwise or counter clockwise, as indicated by the arrow 780. While illustrated as closing or completely covering the first inlets 635, it is contemplated that the first perforated ring 770 can rotate to partially cover or completely uncover or open the first inlets 635 to fluidly couple the interior 62 of the combustion chamber 50 to the exterior 64 of the combustion chamber 50.

Additionally, or alternatively, adjustment of the size of the window 772 or angle of rotation of the first perforated ring 770 can be used to change effective area or velocity of airflow through the first set of dilution holes 60. The windows 772, as illustrated by way of example, can have varying sizes or spacing. Alternatively, one or more of the spacing or size can be equal from one window 772 to another. Further, it is contemplated that structures can be added to the first perforated ring 770 that change the size or shape of the windows 772.

While illustrated as having varying sizes and spacing, it is contemplated that the first inlets 635 can be equally sized first inlets 635 or evenly spaced in a circumferential arrangement about the combustion chamber 50.

Benefits of aspects of the disclosure include airflow velocity control that can be used to avoid high shear between two or more swirling air streams.

Additionally, aspects of the disclosure can be used to create a high velocity airflow on swirler outer diameter and fuel nozzle outer diameter to avoid flame holding.

Movable walls near swirler inlets allow for air flow tailoring for each circuit based on operating condition needs. Air flow tailoring can allow for high velocities on fuel nozzle outer diameter for low power condition to avoid flame holding on fuel nozzle.

Other aspects of the disclosure provide control of the pressure drop or effective area of one or more passages of air entering the fuel nozzle or defined by the swirler.

The ability to control the pressure drop, velocity, volumetric flow rate, effective area, or direction of the air flow from the HP compressor section to the combustor at the one or more inlets of the combustor allows for the use of use of fuels with higher burn temperatures, like hydrogen fuel. Controlling of the air flow allows for flame shape and position to be tailored for each operating condition. That is, controlling air flow velocity and velocity profile and tailoring for each operation can reduce flame holding or flashback, especially beneficial for fuels with high flame speed.

Additional benefits include air flow control through the swirler based on the fuel flow rate, measured, for example, by a sensor. That is, the air flow control can be automatic or changed in response to a measured or calculated fuel flow rate.

Air flow control through the swirler can also be independent of the fuel flow rate.

The actuation of the set of vanes can change swirl number and thus flame shape.

In this way, it should be appreciated that the examples used herein are not limited specifically as shown, and a person having skill in the art should appreciate that aspects from one or more of the examples can be intermixed and/or combined with one or more aspect from other examples to define examples that can differ from the examples as shown.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects of the disclosure are provided by the subject matter of the following clauses:

A turbine engine comprising a compressor section, a combustion section, and a turbine section in serial flow arrangement, the combustion section comprising a combustor liner, a dome assembly coupled to the combustor liner, a fuel nozzle fluidly coupled to the dome assembly, a combustion chamber fluidly coupled to the fuel nozzle and defined at least in part by the combustor liner and the dome assembly, at least one set of dilution openings located in the dome assembly or the combustor liner and fluidly coupled to the combustion chamber, a swirler defining at least one passage extending between at least one annular entrance and at least one annular exit, wherein the at least one annular entrance is fluidly coupled to the compressor section, at least one set of vanes located in the at least one passage and circumferentially arranged about the fuel nozzle, and a variable area device movable to alter an effective area of the at least one set of dilution openings or at least a portion of the swirler.

The turbine engine of the preceding clause, wherein the variable area device comprises at least one movable wall, which, upon movement, varies the effective area of the at least one set of dilution openings or the at least a portion of the swirler.

The turbine engine of any of the preceding clauses, wherein the at least one movable wall is slidably movable over the at least one set of dilution openings or the at least a portion of the swirler.

The turbine engine of any of the preceding clauses, wherein the at least one movable wall comprises a pair of opposing walls.

The turbine engine of any of the preceding clauses, wherein each of the pair of opposing walls lies on an axially opposite side of inlets of the at least one set of dilution openings or the at least a portion of the swirler.

The turbine engine of any of the preceding clauses, wherein the opposing walls are slidably movable toward each other.

The turbine engine of any of the preceding clauses, further comprising a fuel passage, wherein at least one sensor or actuator is in fluid communication with the fuel passage.

The turbine engine of any of the preceding clauses, wherein the variable area device is automatically adjusted based a flow of fluid in the fuel passage determined by the sensor or the actuator.

The turbine engine of any of the preceding clauses, further comprising a fuel passage fluidly coupled to the combustion chamber, wherein the fuel passage is a hydrogen fuel passage providing a hydrogen fuel or hydrogen fuel mixes to the combustion chamber downstream of the at least one annular exit.

The turbine engine of any of the preceding clauses, wherein the variable area device pivots at least one vane of the at least one set of vanes, wherein pivoting the at least one vane through an arc varies the effective area of the at least one passage.

The turbine engine of any of the preceding clauses, wherein the variable area device separately pivots a subset of vanes of the at least one set of vanes through an arc different than a remainder subset of the set of vanes.

The turbine engine of any of the preceding clauses, wherein the variable area device comprises a baffle with multiple, circumferentially spaced windows circumscribing the at least one set of dilution openings or at least a portion of the swirler.

The turbine engine of any of the preceding clauses, wherein the multiple, circumferentially spaced windows are equally spaced.

The turbine engine of any of the preceding clauses, wherein the multiple, circumferentially spaced windows are the same size.

The turbine engine of any of the preceding clauses, wherein rotation of the baffle or axial movement of the baffle varies the effective area of the at least one set of dilution openings or at least a portion of the swirler.

The turbine engine of any of the preceding clauses, wherein the at least one set of vanes comprises at least a first set of vanes and a second set of vanes, which is axially spaced from the first set of vanes.

A swirler assembly for a combustor of a turbine engine, the swirler assembly comprising a swirler defining at least one passage extending between at least one annular entrance and at least one annular exit, at least one set of vanes located in the at least one passage, and a variable area device movable to alter an effective area of at least a portion of the swirler.

The swirler assembly of any of the preceding clauses, wherein the variable area device comprises at least one movable wall, which, upon movement, varies the effective area of the at least one annular entrance.

The swirler assembly of any of the preceding clauses, wherein the variable area device pivots at least one vane of the at least one set of vanes and permitting pivotal movement of the at least one vane through an arc to vary the effective area of the at least one passage.

The swirler assembly of any of the preceding clauses, wherein the variable area device comprises a baffle with multiple, circumferentially spaced windows circumscribing the at least one annular entrance, whereby rotation or axial motion of the baffle varies the effective area of the at least one annular entrance.

What is claimed is:

1. A turbine engine comprising:

a compressor section, a combustion section, and a turbine section in serial flow arrangement defining a rotational axis extending from a forward to an aft, the combustion section comprising:

a combustor liner;

a dome assembly coupled to the combustor liner;

a fuel nozzle terminating at a nozzle tip and coupled to the dome assembly;

a combustion chamber fluidly coupled to the fuel nozzle and defined at least in part by the combustor liner and the dome assembly;

a swirler, positioned forward of the nozzle tip and circumscribing the fuel nozzle, the swirler comprising:

a forward wall including a forward outer surface;

an aft wall spaced from the forward wall and including an aft outer surface;

a central wall provided between the forward wall and the aft wall defining a forward passage and an aft passage;

a first variable area device located at the forward outer surface and slidable along the forward outer surface toward the aft to decrease an effective area of the forward passage; and a second variable area device located at the aft outer surface and slidable along the aft outer surface toward the forward to decrease an effective area of the aft passage.

2. The turbine engine of claim 1, further comprising a fuel passage, wherein at least one sensor or at least one actuator is in fluid communication with the fuel passage.

3. The turbine engine of claim 2, wherein the first variable area device and the second variable area device are automatically adjusted based a flow of fluid in the fuel passage determined by the at least one sensor or the at least one actuator.

4. The turbine engine of claim 1, further comprising a fuel passage fluidly coupled to the combustion chamber, wherein the fuel passage is a hydrogen fuel passage providing a hydrogen fuel or hydrogen fuel mixes to the combustion chamber.

5. The turbine engine of claim 1, wherein at least one of the first variable area device or the second variable area device comprises a baffle with multiple, circumferentially spaced windows circumscribing at least a portion of the swirler.

6. The turbine engine of claim 5, wherein the multiple, circumferentially spaced windows are equally spaced.

7. The turbine engine of claim 6, wherein the multiple, circumferentially spaced windows are a same size.

8. The turbine engine of claim 5, wherein rotation of the baffle or axial movement of the baffle varies the effective area of at least a portion of the swirler.

9. The turbine engine of claim 1 wherein the forward wall and the central wall define a first inlet for the forward passage, and wherein the first variable area device is positioned exterior of the first inlet.

10. The turbine engine of claim 9 wherein the central wall and the aft wall define a second inlet for the aft passage, and wherein the second variable area device is positioned aft of the first variable area device.

11. The turbine engine of claim 1 further comprising a splitter extending from the central wall, at least partially defining the forward passage and the aft passage.

12. The turbine engine of claim 11 wherein the splitter turns from a radial direction to an axial direction.

13. The turbine engine of claim 11 wherein the splitter terminates forward of the nozzle tip.

14. The turbine engine of claim 13 wherein the aft wall terminates within the combustion chamber.

15. The turbine engine of claim 11 further comprising a nozzle cap positioned within the fuel nozzle and terminating forward of the nozzle tip, wherein an aft end of the splitter is aligned with the nozzle cap.

16. The turbine engine of claim 1 wherein the central wall comprises a central outer surface, and wherein the first variable area device is slidable along the forward outer surface toward the central outer surface and the second variable area device is slidable along the aft outer surface toward the central outer surface.

17. The turbine engine of claim 1, wherein the first variable area device is movable independent of the second variable area device.

18. A swirler assembly for a combustor of a turbine engine, the swirler assembly comprising:

a fuel nozzle terminating at a nozzle tip;

a swirler circumscribing the fuel nozzle and positioned forward of the nozzle tip, and the swirler comprising:

a forward wall defining a forward outer surface;

an aft wall spaced from the forward wall and defining an aft outer surface;

a central wall positioned between the forward wall and the aft wall defining a forward passage at the forward wall and an aft passage at the aft wall;

a first variable area device circumscribing the forward passage and movable along the forward outer surface toward the aft passage to decrease an effective area of the forward passage;

and a second variable area device circumscribing the aft passage and movable along the aft outer surface toward the forward passage to decrease an effective area of the aft passage.

19. The swirler assembly of claim 18, wherein the first variable area device comprises a baffle with multiple, circumferentially spaced windows circumscribing the forward passage.

20. The swirler assembly of claim 18 wherein the swirler further comprises a splitter extending from the central wall, wherein the splitter terminates forward of the nozzle tip.

* * * * *